US006736675B2

(12) United States Patent
Kato et al.

(10) Patent No.: US 6,736,675 B2
(45) Date of Patent: May 18, 2004

(54) CONNECTOR

(75) Inventors: Tetsuo Kato, Shizuoka-ken (JP); Takao Murakami, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 14 days.

(21) Appl. No.: 10/055,887

(22) Filed: Jan. 28, 2002

(65) Prior Publication Data

US 2002/0111066 A1 Aug. 15, 2002

(30) Foreign Application Priority Data

Feb. 13, 2001 (JP) ..... 2001-035433

(51) Int. Cl.[7] ..... H01R 13/40
(52) U.S. Cl. ..... 439/595; 439/352; 439/752
(58) Field of Search ..... 439/351, 352, 439/752, 595, 744

(56) References Cited

U.S. PATENT DOCUMENTS 4,479,691 A * 10/1984 Smith, Jr. ..... 439/744
5,876,244 A * 3/1999 Tabata ..... 439/521
5,944,557 A * 8/1999 Fukuda ..... 439/595
6,146,200 A * 11/2000 Ito et al. ..... 439/596

FOREIGN PATENT DOCUMENTS

| | | |
|---|---|---|
| JP | 50-53688 | 9/1948 |
| JP | 54-12790 | 6/1952 |
| JP | 63313478 | 3/1989 |
| JP | 5-30031 | 8/1989 |
| JP | 8007969 | 7/1997 |
| JP | 8306431 | 5/1998 |
| JP | 11-265750 | 1/2001 |

* cited by examiner

*Primary Examiner*—Tho D. Ta
*Assistant Examiner*—James R. Harvey
(74) *Attorney, Agent, or Firm*—Finnegan, Henderson, Farabow, Garrett & Dunner, L.L.P.

(57) ABSTRACT

A connector comprises a housing main body 27, a stopper having a flexibility, and a spacer 29. The housing main body is provided with a deflection restricting means 37 which with said spacer 29 in contact with said stopper 35, restricts said stopper 35 from being deflected in the installation direction of said spacer 29 onto said housing main body 27.

6 Claims, 11 Drawing Sheets

CONNECTOR

BACKGROUND OF THE INVENTION

1. Field of the Invention

The present invention relates to a connector detecting an incomplete insertion of a terminal into a terminal accommodating chamber at the time of installation.

2. Description of the Related Art

Japanese Patent Application Publication No. 5-30031 has disclosed a related connector. As shown in FIGS. 1 to 3, this connector comprises a housing main body 3 in which a terminal 1 is inserted and accommodated, a spacer member 5 which, if the terminal 1 is inserted incompletely therein, blocks installation of the terminal 1 into the housing main body 3 and a sealing member 7 which is disposed inside the housing main body 3 in order to seal a gap with a fit mating connector. The housing main body 3 contains terminal accommodating chambers 9, 9 which are protruded from a proximal portion in a direction and in which each terminal 1 is inserted and accommodated. This connector further has terminal insertion portions 11, 11, which allow the terminal 1 to be inserted into the terminal accommodating chambers 9, 9, provided on the other side of the housing main body 3 and a fitting hood portion 13 which is provided around the terminal accommodating chambers 9, 9 so as to be fit to a mating connector. The housing main body 3 is provided with stopper portions 15, 15 stopping the terminals 1, 1 inserted into the terminal accommodating chambers 9, 9.

The stopper portions 15, 15 are formed in a cantilever shape having an elasticity. These stopper portions 15, 15 are formed integrally with a base portion 8 of the housing main body 3 on the proximal end side of the terminal accommodating chambers 9, 9 and disposed in respective openings 19, 19 formed in outer peripheral walls 17, 17 of the terminal accommodating chambers 9, 9. These stopper portions 15, 15 are distorted themselves, so that front ends thereof can be deflected with their proximal ends as fulcrum points.

When the spacer member 5 is installed onto the housing main body 3, it covers the outer peripheral walls 17, 17 from the front ends of the terminal accommodating chambers 9, 9 and is disposed on the side of the outer periphery of each of the stopper portions 15, 15.

When such a connector 21 is assembled, the terminal 1 is inserted and accommodated into the terminal accommodating chambers 9, 9 and the spacer member 5 is installed onto the housing main body 3. At this time, the sealing member 7 is installed onto the housing main body 3 preliminarily.

If the terminal 1 is inserted into the terminal accommodating chamber 9, the front end of the stopper portion 15 is deflected outward of the terminal accommodating chamber 9 with the proximal end side as a fulcrum point. Then, when the terminal 1 is inserted into the terminal accommodating chamber 9 properly, the stopper portion 15 is restored to its original state due to elasticity thereby stopping the terminal 1. Then, the stopper portion 15 is entirely accommodating in the opening 19 of the terminal accommodating chamber 9.

Then, the spacer member 5 is installed onto the housing main body 3. Consequently, the spacer member 5 covers the outer peripheral wall 17 of the terminal accommodating chamber 9 and is disposed outside the stopper portion 15. As a result, the spacer member 5 prevents the stopper portion 15 from being distorted carelessly.

If the terminal 1 is inserted into the terminal accommodating chamber 9 incompletely, the front end of the stopper portion 15 is deflected outward of the terminal accommodating chamber 9. If the spacer member 5 is installed onto the housing main body 3 under this condition, the spacer member 5 comes into contact with the front end of the stopper portion 15. At this time, the stopper portion 15 blocks installation of the spacer member 5 onto the housing main body 3 due to its own elasticity. Therefore, this connector 21 enables detecting an incomplete insertion of the terminal 1 into the terminal accommodating chamber 9 at the time of the installation.

SUMMARY OF THE INVENTION

However, when the spacer member 5 comes into contact with the front end of the stopper portion 15 in the aforementioned related connector 21, installation of the spacer member 5 onto the housing main body 3 is blocked by elasticity of the stopper portion 15. Thus, if a force in the installation direction onto the housing main body 3 is applied to the spacer member 5 resisting the elastic force of the stopper portion 15, the front end of the stopper portion 15 may be deflected in the installation direction of the spacer member 5 onto the housing main body 3.

Thus, in the connector 21, even if the insertion of the terminal 1 into the terminal accommodating chamber 9 is incomplete because of breaking of the stopper portion 15 at its proximal end or the other reason, the installation of the spacer member 5 onto the housing main body 3 is sometimes achieved without being blocked. As a result, the conventional connector 21 is sometimes incapable of detecting an incomplete insertion of the terminal 1 into the terminal accommodating chamber 9.

Further, in case where the stopper portion 15 is damaged, for example, broken, even if the insertion of the terminal 1 into the terminal accommodating chamber 9 is complete, sometimes, the terminal 1 cannot be stopped so that after the connector 21 is assembled, the terminal 1 may slip out of the housing main body 3.

Further, in the connector 21, it is necessary to pay special attention to an installation force when installing the spacer member 5 onto the housing main body 3 in order to prevent the stopper portion 15 from being damaged. For the reason, working efficiency of the installation drops entirely.

Accordingly, an object of the present invention is to provide a connector which, when a spacer member is blocked from being installed onto a housing main body, protects a stopper portion from a damage and further prevents working efficiency of the installation from being lowered.

To achieve the above object, according to a first aspect of the present invention, there is provided a connector comprising: a housing main body having a terminal accommodating chamber into which a terminal is to be inserted; a stopper portion which is provided on the housing main body and has a flexibility allowing when the terminal is inserted into the terminal accommodating chamber, to be deflected outward with respect to the terminal accommodating chamber and when the terminal is inserted into the terminal accommodating chamber properly, to be restored to a normal state, so as to stop the terminal; and a spacer member which is to be installed onto the housing main body and if insertion of the terminal into the terminal accommodating chamber is incomplete, comes into contact with the deflected stopper portion so that it is blocked from being installed onto the housing main body, wherein the housing main body is provided with deflection restricting means which with the spacer member in contact with the stopper portion, restricts the stopper portion from being deflected in the installation direction of the spacer member onto the housing main body.

According to the first aspect of the invention having such a structure, if the spacer member is installed onto the housing main body with the insertion of the terminal into the terminal accommodating chamber incomplete, such an incomplete insertion of the terminal into the terminal accommodating chamber can be detected because the spacer member comes into contact with the stopper portion.

If, with the spacer member in contact with the stopper portion, a further force is applied to the spacer member in the installation direction onto the housing main body resisting an elastic force of the stopper portion, deflection of the stopper portion in the installation direction of the spacer member onto the housing main body is restricted by the deflection restricting means so as to prevent the stopper portion from being damaged, for example, broken.

According to a second aspect of the present invention, there is provided a connector according to the first aspect wherein the deflection restricting means is comprised of flexible bar-like bodies, links a rear end of the stopper portion in the installation direction of the spacer member onto the housing main body with the terminal accommodating chamber along the installation direction of the spacer member onto the housing main body and avoids the spacer member installed onto the housing main body with insertion of the terminal into the terminal accommodating chamber incomplete, the deflection restricting means being deflected together with the stopper portion when the terminal is inserted into the terminal accommodating chamber and pulling a rear end of the stopper portion in the axial direction when the spacer member comes into contact with the stopper portion with insertion of the terminal into the terminal accommodating chamber incomplete.

According to the second aspect of the invention, if the terminal is inserted into the terminal accommodating chamber, the stopper portion is distorted due to its own elasticity and at the same time, deflection of the stopper portion in an upward direction is allowed due to elasticity of the bar-like bodies.

If with the insertion of the terminal into the terminal accommodating chamber incomplete, the spacer member is installed onto the housing main body, it is so constructed that the bar-like bodies avoid the spacer member so that the spacer member comes into contact with the stopper portion.

Further, if a further force is applied to the spacer member kept in contact with the stopper portion in the installation direction onto the housing main body resisting the elastic force of the stopper portion, the bar-like bodies pull the stopper portion in the axial direction. Consequently, deflection of the stopper portion in the installation direction of the spacer member onto the housing main body can be restricted, so that the stopper portion can be protected from a damage, for example, breaking.

According to a third aspect of the present invention, there is provided a connector according to the second aspect, wherein the bar-like bodies are formed within the terminal accommodating chamber.

According to the third aspect of the invention, the bar-like bodies are formed within the terminal accommodating chamber. Therefore, the deflection restricting means can be provided without enlarging the size of the connector.

According to a fourth aspect of the present invention, there is provided a connector according to the first aspect, wherein the spacer member is disposed outside the stopper portion when installed on the housing main body so as to restrict deflection of the stopper portion.

According to the fourth aspect of the invention, the spacer member is disposed outside the stopper portion when the spacer member is installed onto the housing main body, thereby preventing the stopper portion from being deflected outward of the terminal accommodating chamber carelessly.

DESCRIPTION OF THE PREFERRED EMBODIMENTS

Figure 1:
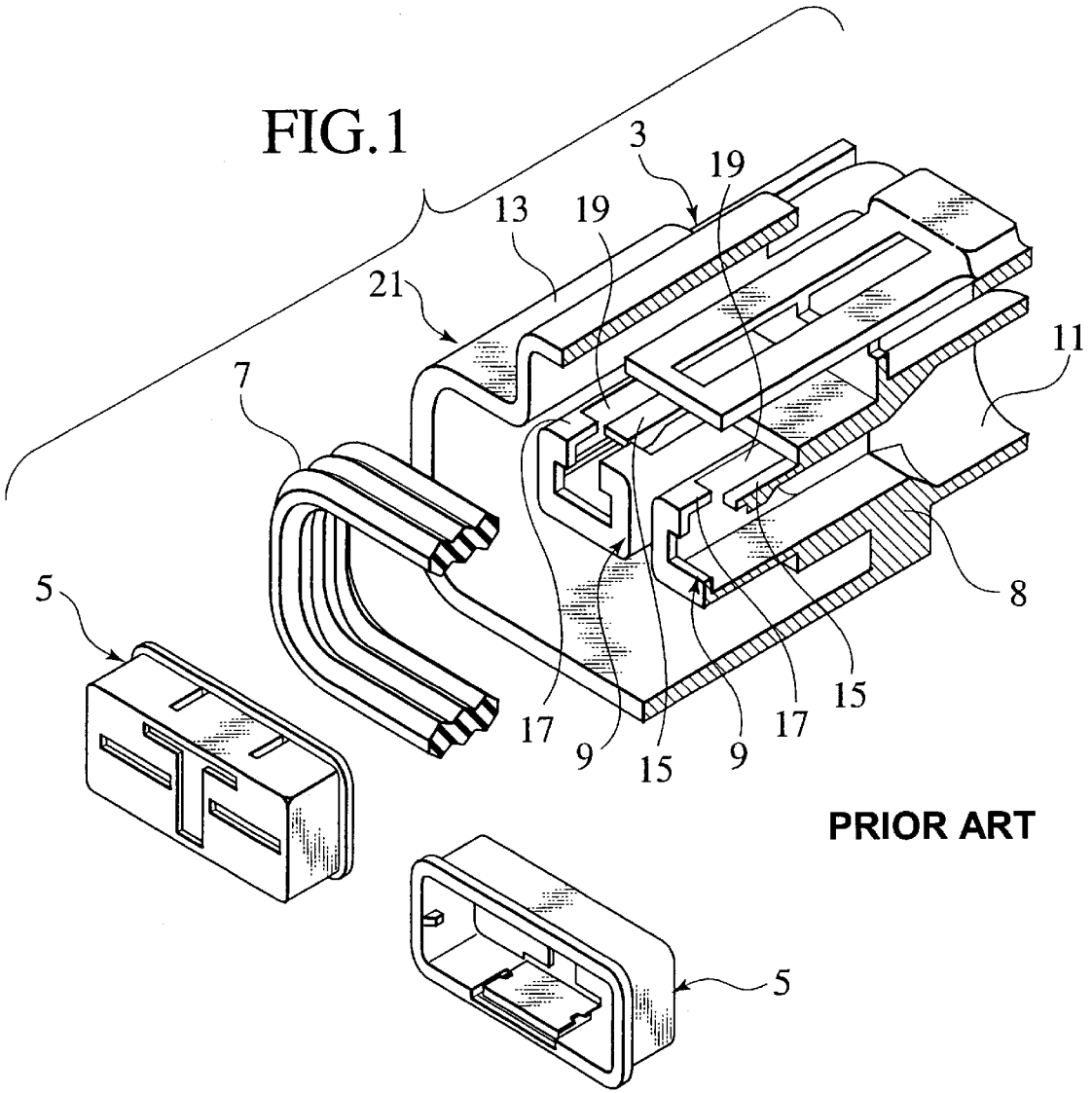
FIG. 1 is an exploded perspective view showing a related connector.
Figure 2:
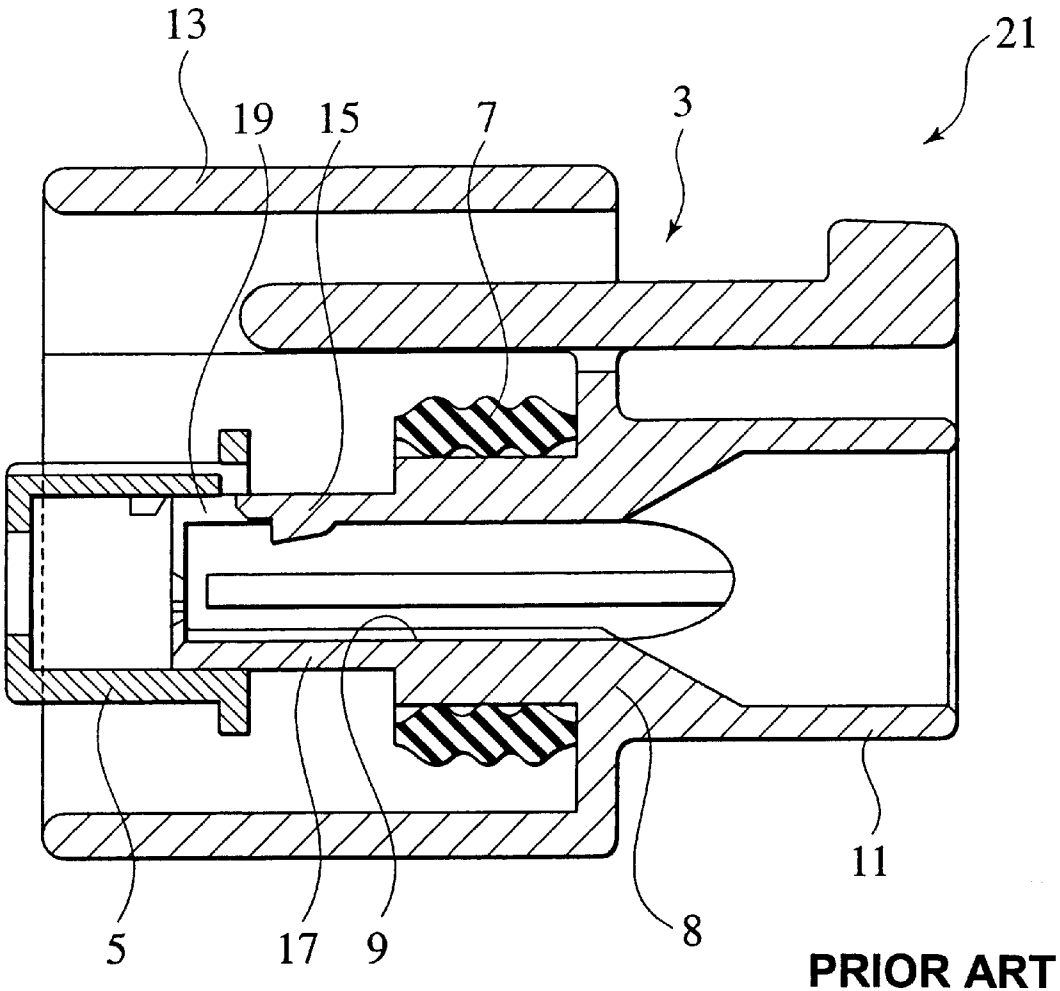
FIG. 2 is a sectional view of the connector shown in FIG. 1.
Figure 3:
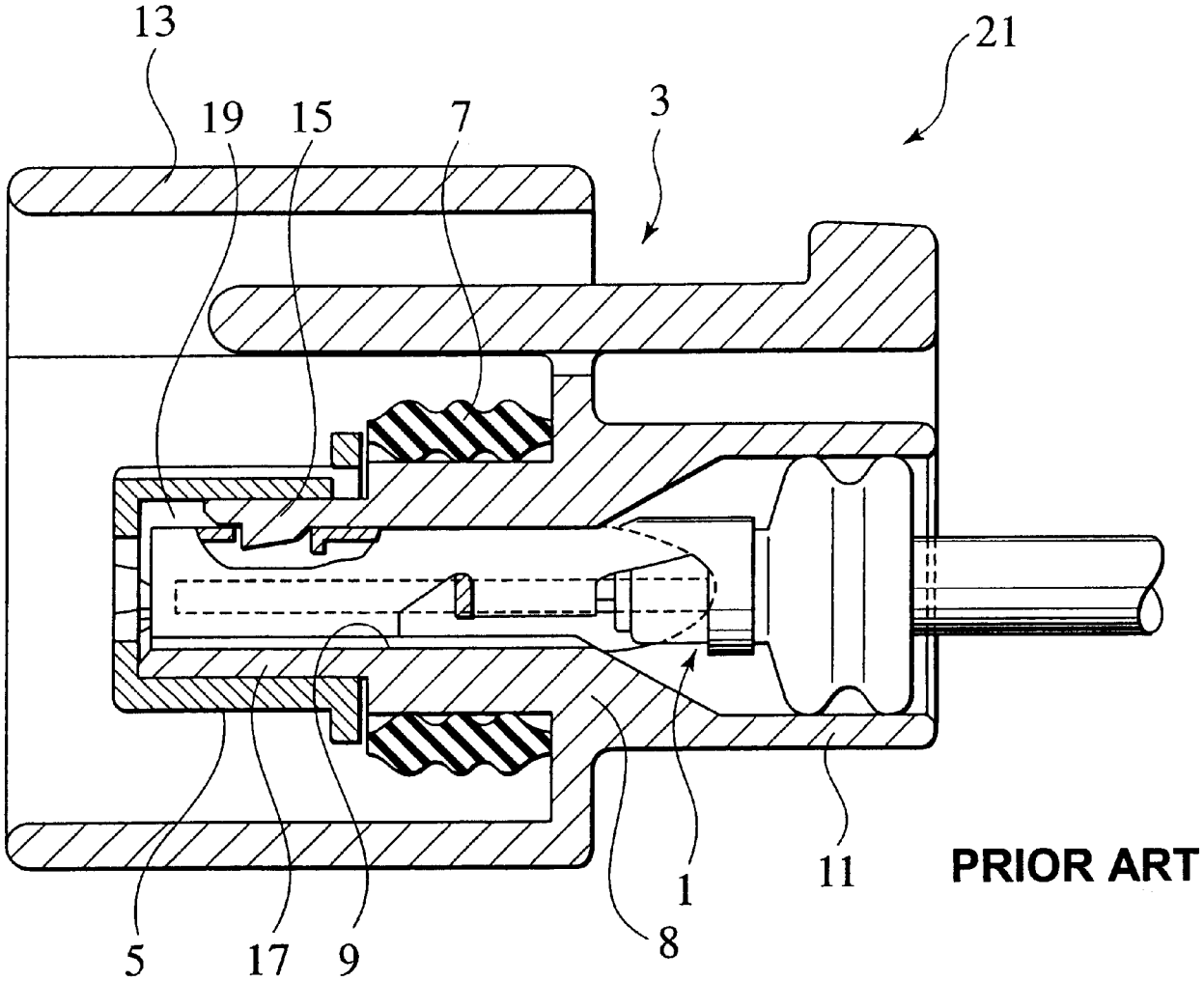
FIG. 3 is a sectional view showing a condition in which the connector shown in FIG. 1 is assembled.
Figure 4:
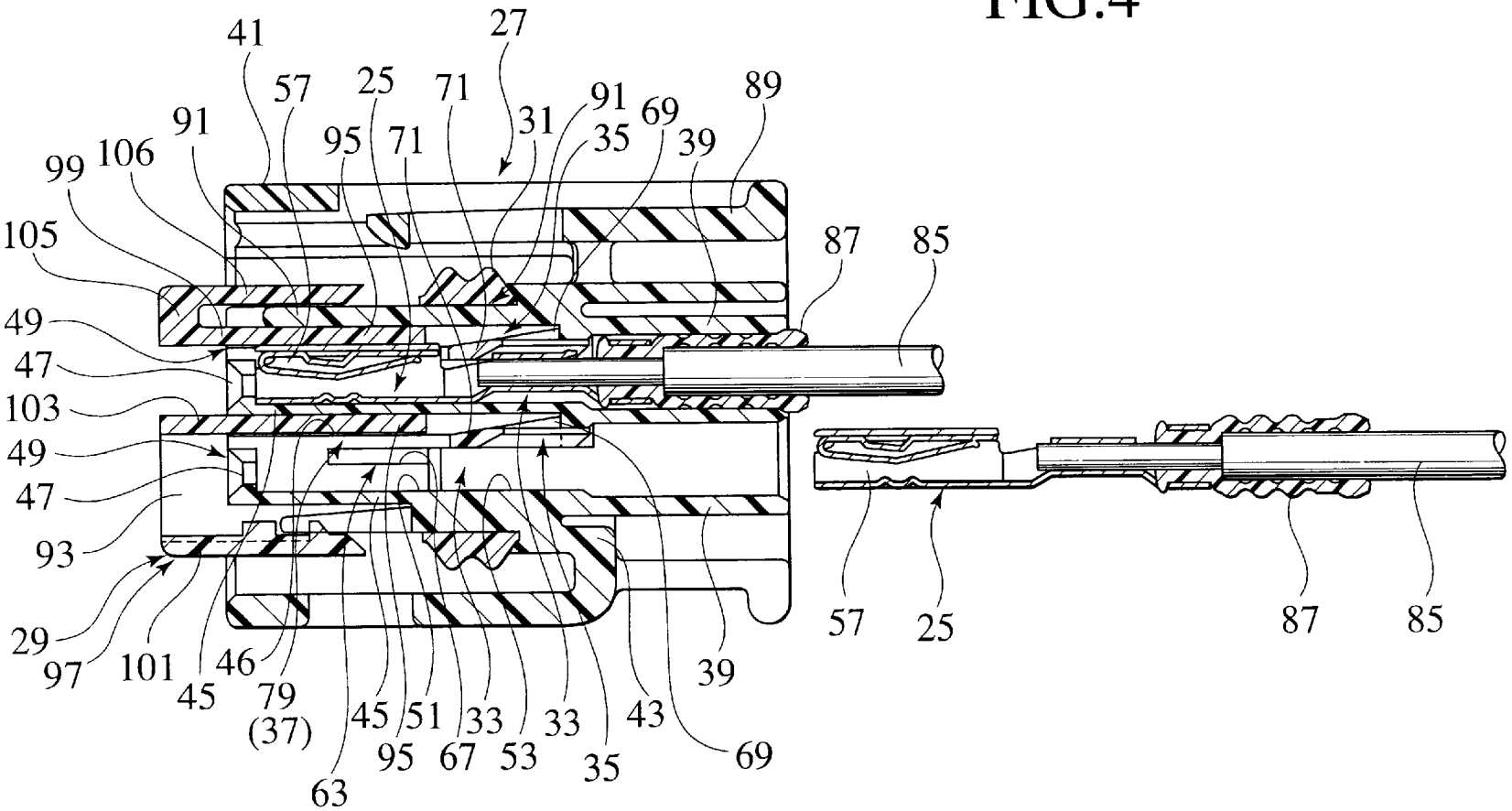
FIG. 4 is a sectional view showing a condition in which a connector according to a first embodiment of the present invention is assembled.
Figure 5:
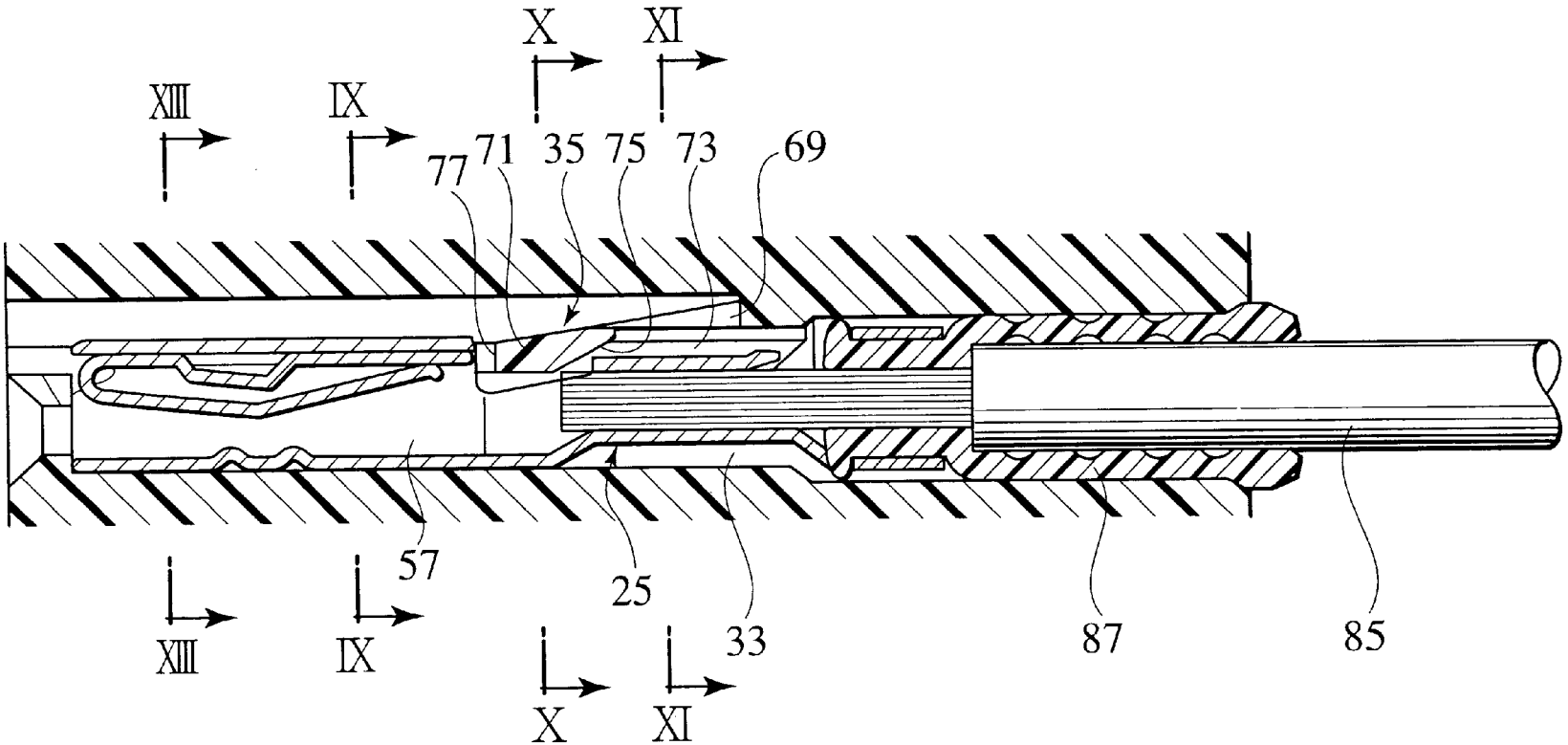
FIG. 5 is an enlarged sectional view of a terminal accommodating chamber shown in FIG. 4.
Figure 6:
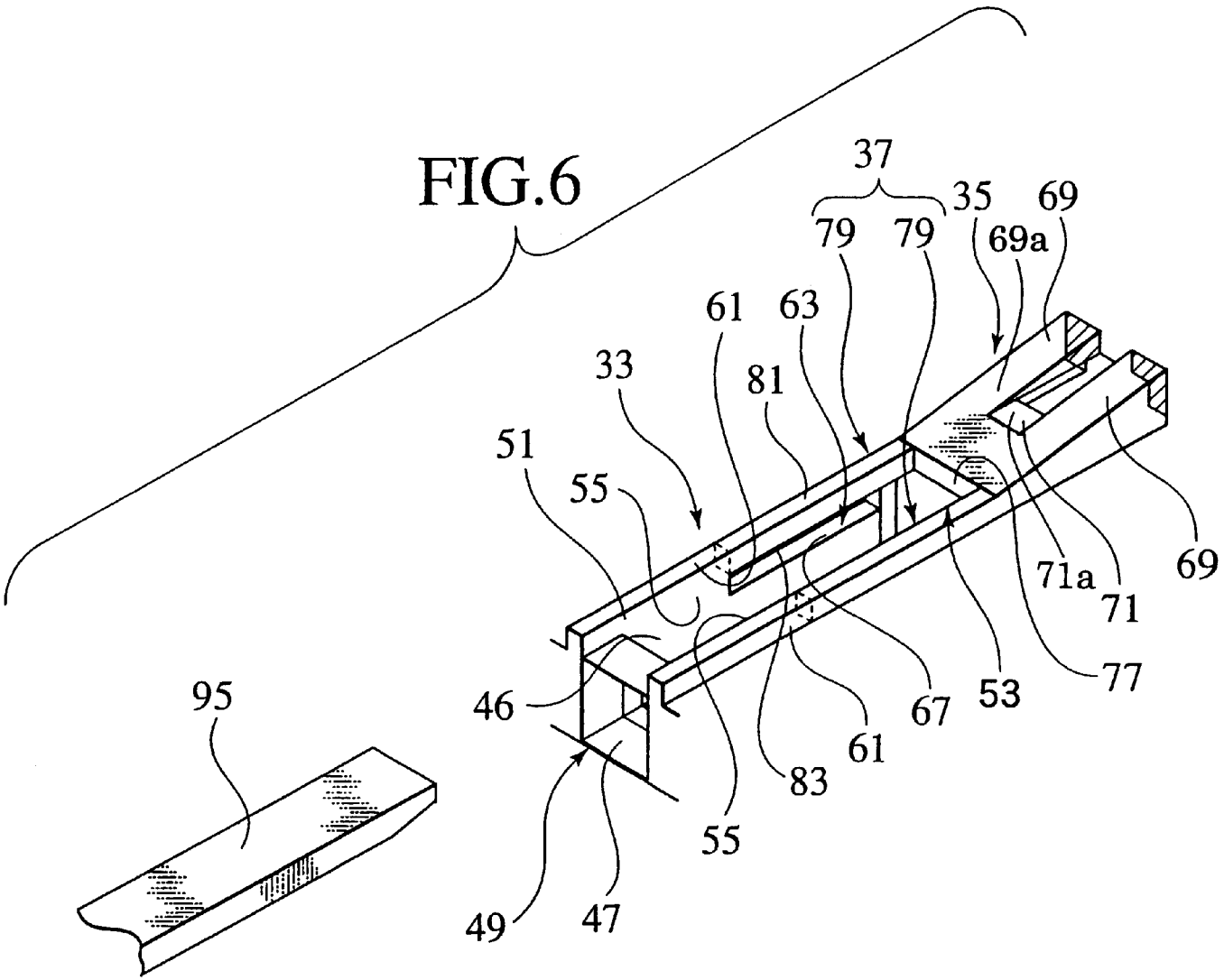
FIG. 6 is an enlarged perspective view of major components of the terminal accommodating chamber shown in FIG. 4.
Figure 7:
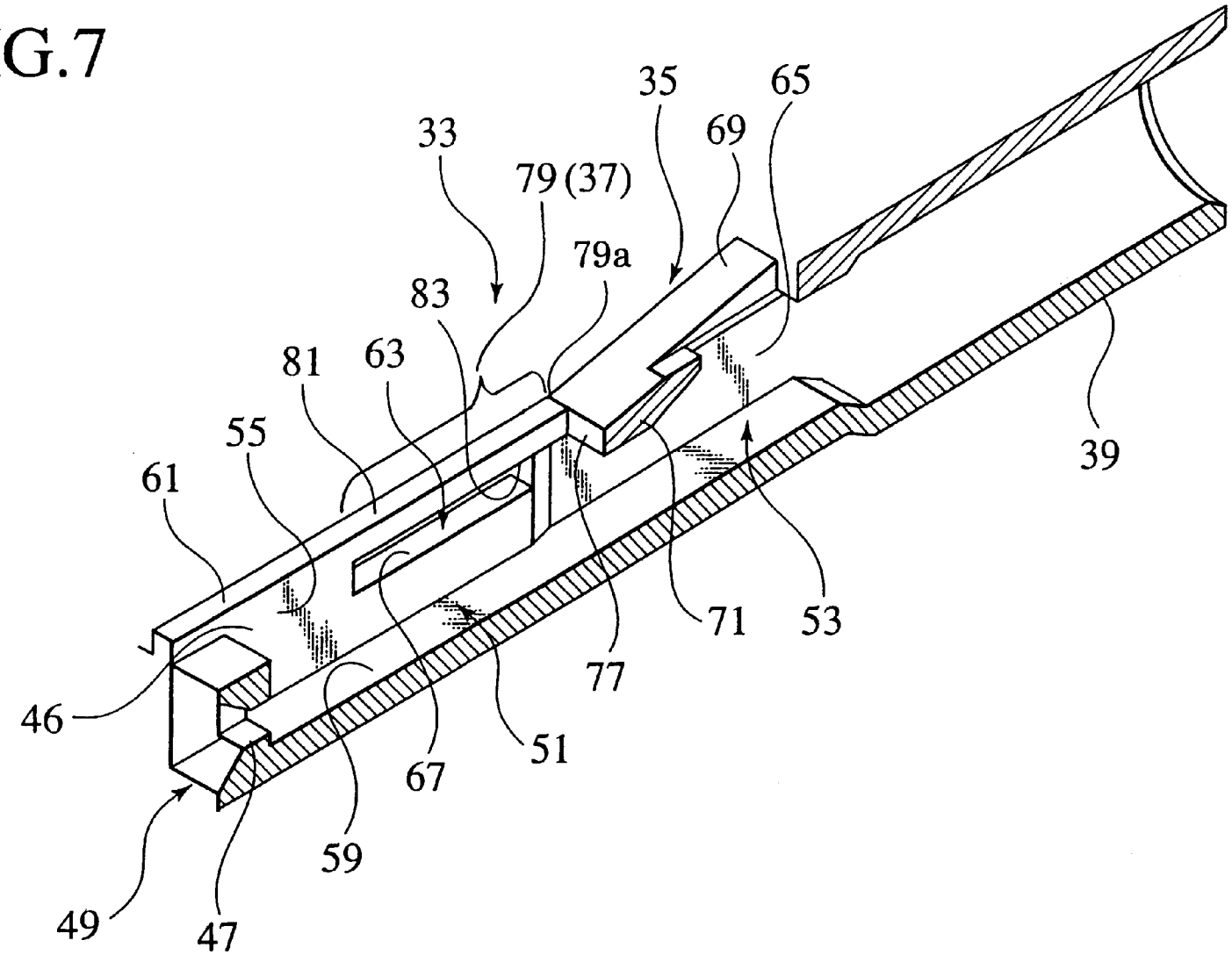
FIG. 7 is a perspective view indicating a section of the terminal accommodating chamber shown in FIG. 6.
Figure 8:
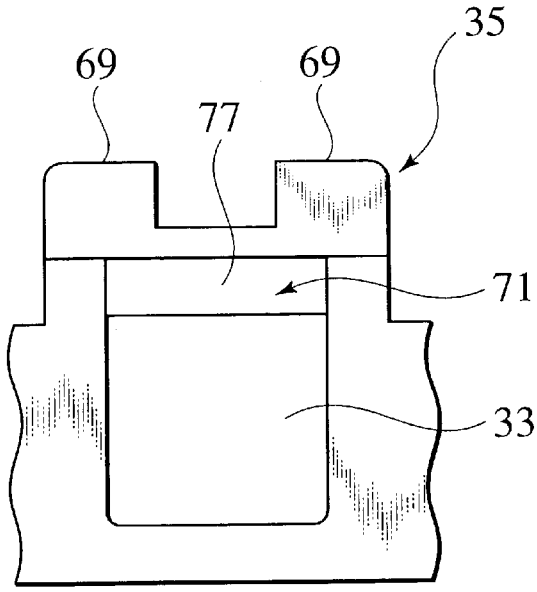
FIG. 8 is a sectional view taken along the lines VIII—VIII of the terminal accommodating chamber shown in FIG. 5.
Figure 9:
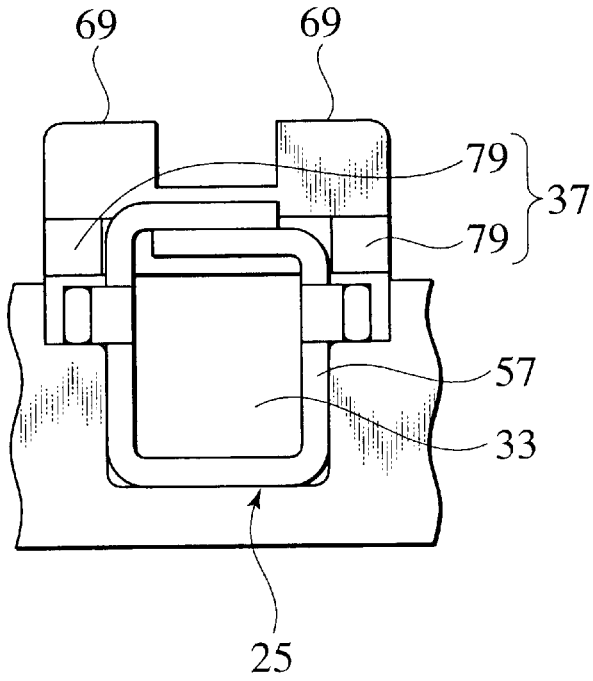
FIG. 9 is a sectional view taken along the lines IX—IX of the terminal accommodating chamber shown in FIG. 5.
Figure 10:
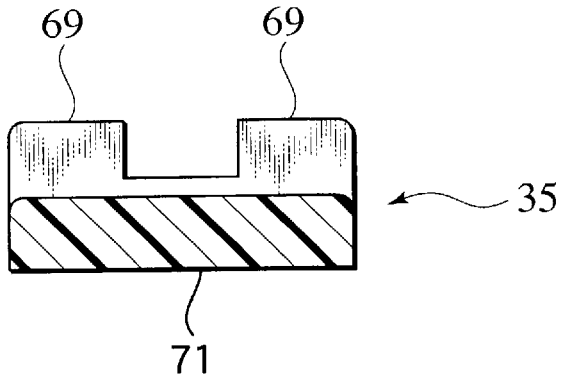
FIG. 10 is a sectional view taken along the lines X—X of the terminal accommodating chamber shown in FIG. 5.

Hereinafter, preferred embodiments of a connector of the present invention will be described with reference to the accompanying drawings. FIG. 4 is a sectional view showing a condition in which the connector of the first embodiment of the present invention is assembled. FIG. 5 is an enlarged sectional view of the terminal accommodating chamber shown in FIG. 4. FIG. 6 is an enlarged sectional view of major components of the terminal accommodating chamber shown in FIG. 4. FIG. 7 is a perspective view indicating a section of the terminal accommodating chamber shown in FIG. 6. Meanwhile, this embodiment will be described about a case where the connector is water resistant.

As shown in FIGS. 4 and 5, a connector 23 comprises a housing main body 27 into which a terminal 25 is to be inserted, a spacer member 29 which is assembled with the housing main body 27 and blocks installation of the terminal 25 if the terminal 25 is inserted into the housing main body 27 incompletely and a sealing member 31 made of annular rubber, which is disposed inside the housing main body 27 for sealing a gap between the housing main body 27 and a mating connector (not shown). The terminal 25 for use in this connector 23 is crimped to an end of wire 85 together with a water-resistant plug 87.

The housing main body 27 comprises a plurality of terminal accommodating chambers 33 which are provided on the front side of the housing main body for accommodating the terminals 25, stopper portions 35 for stopping each terminal 25 inserted into the terminal accommodating chambers 33 and deflection restricting means 37 provided between the stopper portion 35 and the terminal accommodating chamber 33. The housing main body 27 further comprises a terminal insertion portion 39, which is provided on the rear side of the housing main body so as to insert the terminal 25 into the terminal accommodating chambers 33 and a fitting hood portion 41 which is provided around the terminal accommodating chambers 33 and fit to a mating connector. Meanwhile, the housing main body 27 is made of synthetic resin.

A plurality of the terminal accommodating chambers 33 are provided protrudedly from a proximal portion 43 of the housing main body 27 toward a front portion thereof and formed on sheet-like portions 45, 45 formed having a predetermined gap in a vertical direction of the housing main body 27. These terminal accommodating chambers 33 are formed in a concave shape each having an opening 46 in the top portion thereof and provided along the back/forth direction of the housing main body 27, which coincides with an installation direction of a spacer member 29 onto the housing main body 27, on the top face of the aforementioned sheet-like portions 45, 45. The terminal accommodating chambers 33 are provided in parallel in the width direction of the sheet-like portion 45 having a predetermined interval between adjacent ones. The front ends of the plural terminal accommodating chambers 33 are closed by a front end wall 49 having an insertion opening 47 through which a mating terminal is to be inserted. A rear end communicates with the rear side of the housing main body 27 through the proximal portion 43. Each of the plural terminal accommodating chambers 33 is comprised of a small-diameter portion 51 formed from the front end up to an intermediate portion and a large-diameter portion 53 formed from the intermediate portion to the rear end.

As shown in FIGS. 6 and 7, an interval between opposing side faces 55, 55 of the small-diameter portion 51 is formed in a dimension substantially the same as or slightly larger than the dimension in the width direction of a contact portion 57 (not shown) of the terminal 25 which comes into contact with the mating terminal. A height of this small-diameter portion 51 from a bottom face 59 to an upper edge of the side faces 55, 55 is formed to be smaller than the height of the contact portion 57 of the terminal 25, which will be described later. The length of the small-diameter portion 51 in the longitudinal direction is substantially the same as that of the contact portion 57 of the terminal 25 in the longitudinal direction (see FIG. 4). When the terminal 25 is inserted into the terminal accommodating chambers 33 properly, the contact portion 57 is accommodated in the small-diameter portion 51. This small-diameter portion 51 has protruded rows 61, 61 provided on opening edges of the opening 46.

As shown in FIGS. 6 and 7, the protruded rows 61, 61 are formed in the shape of a long bar having a substantially square cross section and formed integrally in the longitudinal direction on the upper edges of the side faces 55, 55 from the front end of the small-diameter portion 51 up to the front end of each of stepped portions 63, 63 described later.

In the large-diameter portion 53 disposed behind this small-diameter portion 51, as shown in FIG. 7, side faces 65, 65 are connected with side faces 55, 55 of the small-diameter portion 51 through a slope expanded toward the rear portion in the width direction of the housing main body 27 and a distance between the side faces 65, 65 is larger than a distance between the side faces 55, 55 of the small-diameter portion 51.

In the terminal accommodating chambers 33 formed in this way, as shown in FIGS. 4, 6 and 7, the stepped portions 63, 63 are formed on the opening edges of the opening 46 from the intermediate portion of the small-diameter portion 51 up to the proximal portion 43. The stepped portions 63 are formed in a concave shape downward from the upper edges of the side faces 55, 55 of the small-diameter portion 51 and the side faces 65, 65 of the large-diameter portion 53. A top face 67 of the stepped portion 63 is disposed below the upper edge of the side face 55 of the small-diameter portion 51 and formed in the back/forth direction of the housing main body 27. This stepped portion 63 accommodates an end of the stopper portion 35 in a portion disposed in the large-diameter portion 53.

The stopper portion 35 is comprised of a pair of long cantilevered bar-like portions 69, 69 having flexibility and stopper protrusions 71 provided at each end of these bar-like portions 69, 69. As shown in FIGS. 6, and 8 to 11, the bar-like portions 69, 69 are disposed such that they oppose each other in the width direction of the housing main body 27 (not shown) with a predetermined interval and formed in the longitudinal direction of the housing main body 27.

As shown in FIG. 4, one side of each of these bar-like portions 69, 69 in the longitudinal direction is formed integrally with the upper portion of the opening edge of the terminal accommodating chamber 33 formed in front of the proximal portion 43 so that it acts as a proximal end. The other side of the bar-like portion 69 is a front end protruded to the front of the housing main body 27. The front end of each of these bar-like portions 69, 69 is disposed within the stepped portion 63 of the large-diameter portion 53 located slightly backward of the rear end of the small-diameter portion 51. The front end of each of the bar-like portions 69, 69 is deflectable in a vertical direction which corresponds to outside or inside of the terminal accommodating chamber 33 with respect to the proximal end.

Figure 11:
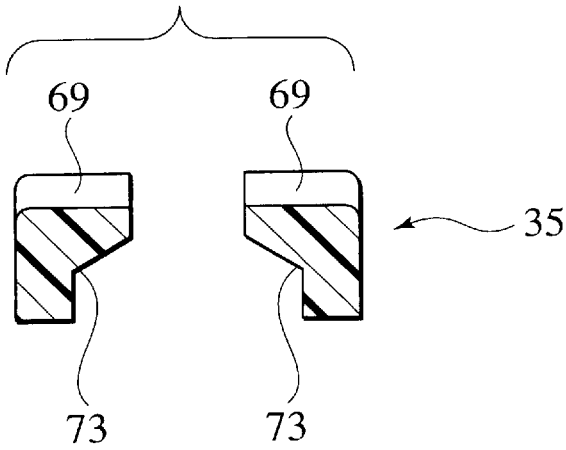
FIG. 11 is a sectional view taken along the lines XI—XI of the terminal accommodating chamber shown in FIG. 5.
Figure 12:
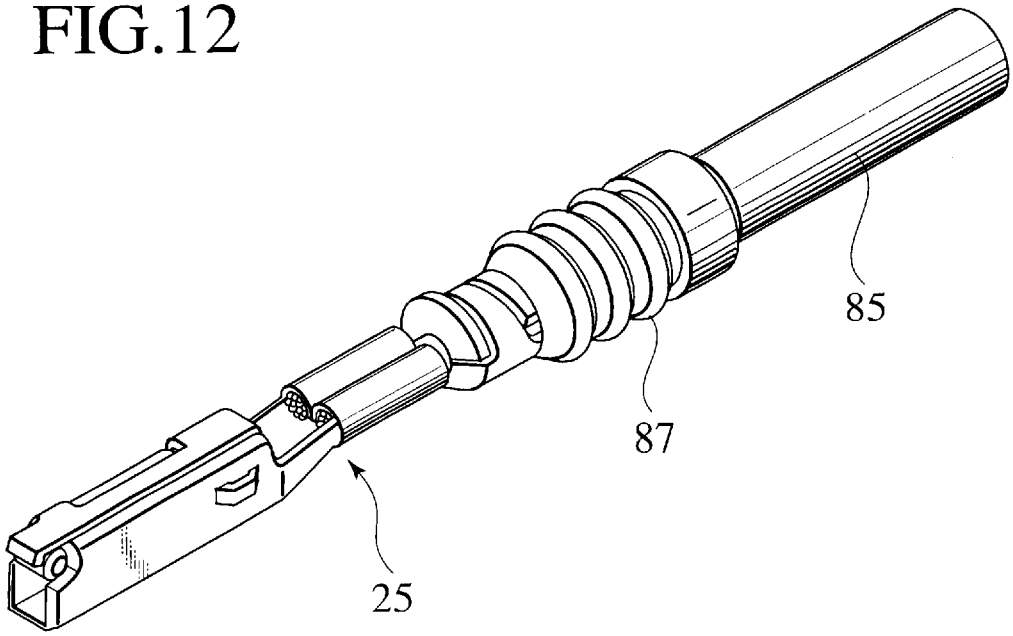
FIG. 12 is a perspective view showing a terminal for use in the connector shown in FIG. 4.

The top face of each of these bar-like portions 69, 69 is inclined gradually from the rear side to the front side. As shown in FIGS. 6 and 11, the bar-like portions 69, 69 contain cutout portions 73, 73 formed from opposing faces thereof to bottom faces in order to avoid the terminal 25 inserted into the terminal accommodating chamber 33. A stopper protrusion 71 is provided between the front ends 69*a*, 69*a* of the bar-like portions 69, 69.

As shown in FIG. 5, both sides of the stopper protrusion 71 in the width direction is formed integrally with the cutout portions 73, 73 in the bar-like portions 69, 69. The top face 71*a* (see FIG. 6) of the stopper protrusion 71 is formed substantially flush with the top face of each of the bar-like portions 69, 69. This stopper protrusion 71 is formed such that a rear end face 75 thereof is inclined downward from the rear end to the front end, toward the terminal accommodating chamber 33. When the terminal 25 is inserted into the terminal accommodating chambers 33, the stopper protrusion 71 and the ends of the bar-like portions 69, 69 slide on the contact portion 57 of the terminal 25 so that they are deflected upward with respect to the terminal accommodating chambers 33. When the terminal 25 is inserted into the terminal accommodating chambers 33 properly, a front end face 77 of the stopper protrusion 71 engages a rear end of the contact portion 57 of the terminal 25. When the terminal 25 is inserted into the terminal accommodating chambers 33 incompletely, the front end face 77 of the stopper protrusion 71 makes contact with the spacer member 29 which is installed in the housing main body 27 and will be described later. In this stopper protrusion 71, as shown in FIGS. 6 and 7, the front end face 77 of the stopper portion 35, which is a rear end in the installation direction of the spacer member 29 onto the housing main body 27, is connected to the terminal accommodating chambers 33 through the deflection restricting means 37.

The deflection restricting means 37 is comprised of a pair of long bar-like bodies 79, 79 having flexibility while a cross section thereof is formed in substantially the same shape as that of each of the protruded row portions 61, 61. The bar-like bodies 79, 79 are formed in the terminal accommodating chambers 33 such that they are disposed along the longitudinal direction of the terminal accommodating chamber 33 and accommodated in the stepped portion 63. One side of each of these bar-like bodies 79, 79 in the longitudinal direction is formed integrally with the rear end of each of the protruded row portions 61, 61 while the other side thereof is formed integrally with both sides of the front end face 77 of the stopper protrusion 71 of the stopper portion 35.

Top faces of the bar-like bodies 79, 79 are flush with the top faces of the protruded row portions 61, 61 and there is a gap between bottom faces 83, 83 and the top faces 67, 67 of the stepped portions 63, 63. Then, when the terminal 25 is inserted into the terminal accommodating chambers 33, the bar-like bodies 79, 79 are entirely distorted while the front end of the stopper portion 35 is deflected, thereby allowing deflection of the front end of the stopper portion 35. When the terminal 25 is inserted into the terminal accommodating chamber 33 incompletely, the bar-like bodies 79, 79 substantially prevent the spacer member 29 from being fully installed in the housing main body 27, which will be described later, and restrict an end of the stopper portion 35 from being deflected in the installation direction of the spacer member 29 onto the housing main body 27 by a tensile force in the axial direction when the spacer member 29 comes into contact with the front end face 77 of the stopper protrusion 71. In other words, front ends 79*a*, 79*a* of the bar-like bodies 79, 79 link the small-diameter portions 51, 51 of the terminal accommodating chamber 33 to the front end face 77 of the stopper portion 35, thereby substantially preventing the stopper portion 35 from being deflected in the installation direction (from left to right as shown in the figures) of the contact portion 95 of the spacer member 29 when the terminal 25 is not fully installed in the terminal accommodating chamber 33.

As shown in FIG. 4, the aforementioned terminal insertion portion 39 is formed in a cylindrical form such that it is extended from the rear end of the terminal accommodating chambers 33 to the rear side, so that the terminal 25 can be inserted into the terminal accommodating chambers 33 from the rear side of the housing main body 27. When the terminal 25 is accommodated in the terminal accommodating chambers 33, the terminal insertion portion 39 embraces wire 85 to which the terminal 25 is connected, so that the water-resistant plug 87 fit to the terminal 25 and the wire 85 is inserted into the terminal insertion portion 39 with pressure filling a gap to protect from water.

The fitting hood portion 41 is formed in a cylindrical form and provided protrudedly forward from the proximal portion 43 of the housing main body 27 and the terminal accommodating chambers 33 are protruded therein. This fitting hood portion 41 has an opening substantially the same as or slightly larger than the sectional shape of the mating connector. This fitting hood portion 41 has an engaging arm 89 which engages and holds an engaging portion of the mating connector (not shown). Inside the fitting hood portion 41, a sealing member receiving portion 91 for receiving an annular rubber sealing member 31 is formed at a rear end on an outer face of the terminal accommodating chambers 33 of the housing main body 27.

The spacer member 29 to be installed on the housing main body 27 is comprised of a body portion 93 which is fit to an outer periphery of each of the sheet-like portions 45, 45 of the terminal accommodating chambers 33 of the housing main body 27 and between the sheet-like portions 45, 45, a contact portion 95 provided protrudedly backward from the rear end of this body portion 93, and a holding portion 97 capable of holding the sealing member 31 disposed on the sealing member receiving portion 91 inside the housing main body 27. The body portion 93 is formed in a cylindrical shape and an intermediate wall 103 is provided between an upper wall 99 and a lower wall 101. This body portion 93 is fit to the outer periphery on the front side of each of the sheet-like portions 45, 45 of the terminal accommodating chambers 33 when it is installed on the housing main body 27 and the intermediate wall 103 is fit between the sheet-like portions 45, 45. This body portion 93 includes a plurality of the contact portions 95 provided on each of the upper wall 99 and the intermediate wall 103.

Figure 13:
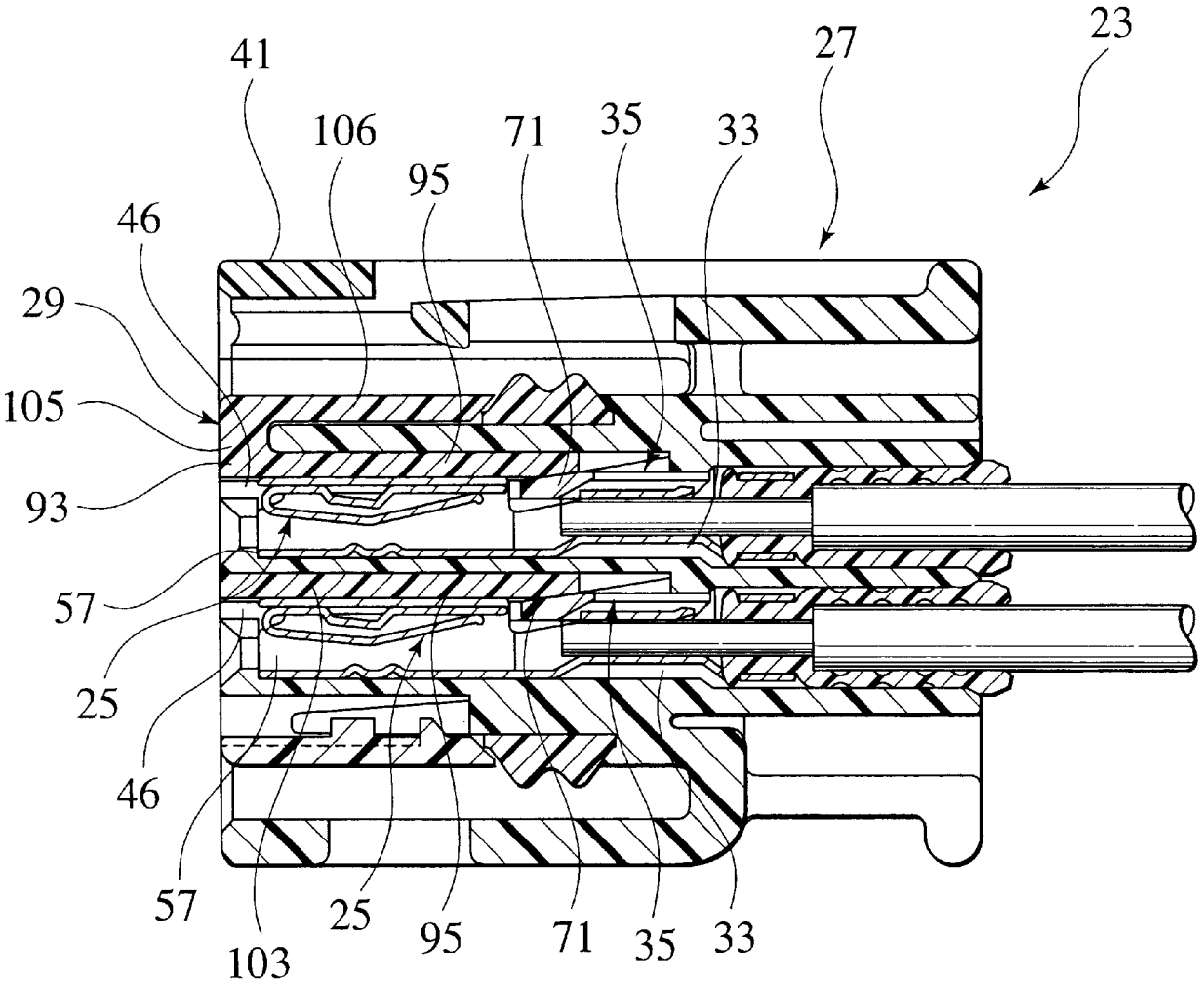
FIG. 13 is a sectional view showing the connector according to the first embodiment of the present invention.

The contact portion 95 is formed in the form of a rectangular plate and one side thereof in the longitudinal direction is formed integrally with the upper wall 99 or the intermediate wall 103, while the other side is disposed so as to be protruded backward in the installation direction to the housing main body 27. As shown in FIG. 6, the contact portion 95 is formed such that the dimension in the width direction is substantially the same as or slightly smaller than the dimension between opposing faces of the bar-like bodies 79 and 79 of the deflection restricting means 37. As shown in FIG. 13, the contact portion 95 is disposed over the opening 46 of the terminal accommodating chambers 33 in a condition in which the spacer member 29 is installed on the housing main body 27. With this condition, the bottom face of the contact portion 95 opposes a top face of the contact portion 57 of the terminal 25 inserted into the terminal accommodating chambers 33 and a front end thereof is in contact with the top face of the stopper protrusion 71, so as to prevent a distortion of the stopper portion 35.

The aforementioned holding portion 97 is comprised of the lower wall 101 of the body portion 93 and an arm portion 106 formed integrally with the body portion 93 through a front linking portion 105. This arm portion 106 is disposed at a predetermined outside position with respect to the body portion 93 and when it is installed to the housing main body 27, an end of the arm portion 106 is in contact with the sealing member 31 together with the lower wall 101 so as to prevent it from slipping out of the housing main body 27.

When installing the aforementioned connector 23, first as shown in FIGS. 4 and 5, the terminal 25 connected to the wire 85 is inserted into the terminal accommodating chambers 33 of the housing main body 27 and the spacer member 29 is installed on the housing main body 27. At this time, the sealing member 31 is placed on the sealing member receiving portion 91.

Next, the terminal 25 is inserted into each terminal insertion portion gradually from the side of the contact portion 57 so that the terminal 25 is inserted into the terminal accommodating chambers 33. If the terminal 25 is inserted into each of the plural terminal accommodating chambers 33, an upper front end of the contact portion 57 of the terminal 25 comes into contact with and presses the rear end face 75 of the stopper protrusion 71. Thus, as the terminal 25 is inserted into the terminal accommodating chambers 33, a front end of the upper portion of the contact portion 57 slides on a rear end face 75 of the stopper protrusion 71 of the stopper portion 35, so that the stopper protrusion 71 which is an end of the stopper portion 35 and each end of the bar-like portions 69, 69 are deflected upward gradually. At this time, the bar-like bodies 79, 79 of the deflection restricting means 37 are deflected entirely depending on the deflections of the stopper protrusion 71 which is the stopper portion 35 and the bar-like bodies 79, 79, so that a rear side thereof is deflected upward together with a front end of the stopper portion 35.

Then, if the terminal 25 is inserted further into the terminal accommodating chambers 33, the stopper protrusion 71 of the stopper portion 35 rides over the contact portion 57 of the terminal 25. At this time, the terminal 25 is inserted into the terminal accommodating chambers 33 with a proper condition so that the contact portion 57 is accommodated in the small-diameter portion 51. At the same time, the front end face 75 of the stopper protrusion 71 of the stopper portion 35 restored due to elasticity of the bar-like bodies 69, 69 engages an upper rear end of the contact portion 57.

With this condition, the terminal 25 is held by the stopper portion 35 in the terminal accommodating chambers 33 so that the terminal 25 is prevented from slipping from the rear side of the housing main body 27. The water-resistant plug 87 connected to the terminal 25 is inserted into the terminal insertion portion 39 with pressure or the like.

After that, the spacer member 29 is installed on the housing main body 27. The installation of the spacer member 29 onto the housing main body 27 is carried out by inserting the spacer member 29 into the fitting hood portion 41 from the rear side. At this time, the outer periphery of each of the sheet-like portions 45, 45 of the terminal accommodating chambers 33 is kept coincident with the inner periphery of the body portion 93.

When the spacer member 29 is installed onto the housing main body 27, as shown in FIG. 13, the body portion 93 of the spacer member 29 is fit to the outer periphery of the front side of the sheet-like portions 45, 45 of the terminal accommodating chambers 33 and the intermediate wall 103 of the body portion 93 is fit between the sheet-like portions 45 and 45. The contact portion 95 of the spacer member 29 is disposed over the opening 46 of the terminal accommodating chambers 33 and a bottom face of the contact portion 95 faces a top face of the contact portion 57 of the terminal 25 in the terminal accommodating chambers 33. Additionally, a front end of the contact portion 95 is disposed on the top face of the stopper protrusion 71 and in contact with the top face thereby preventing an end of the stopper portion 35 from being deflected upward carelessly.

Figure 14:
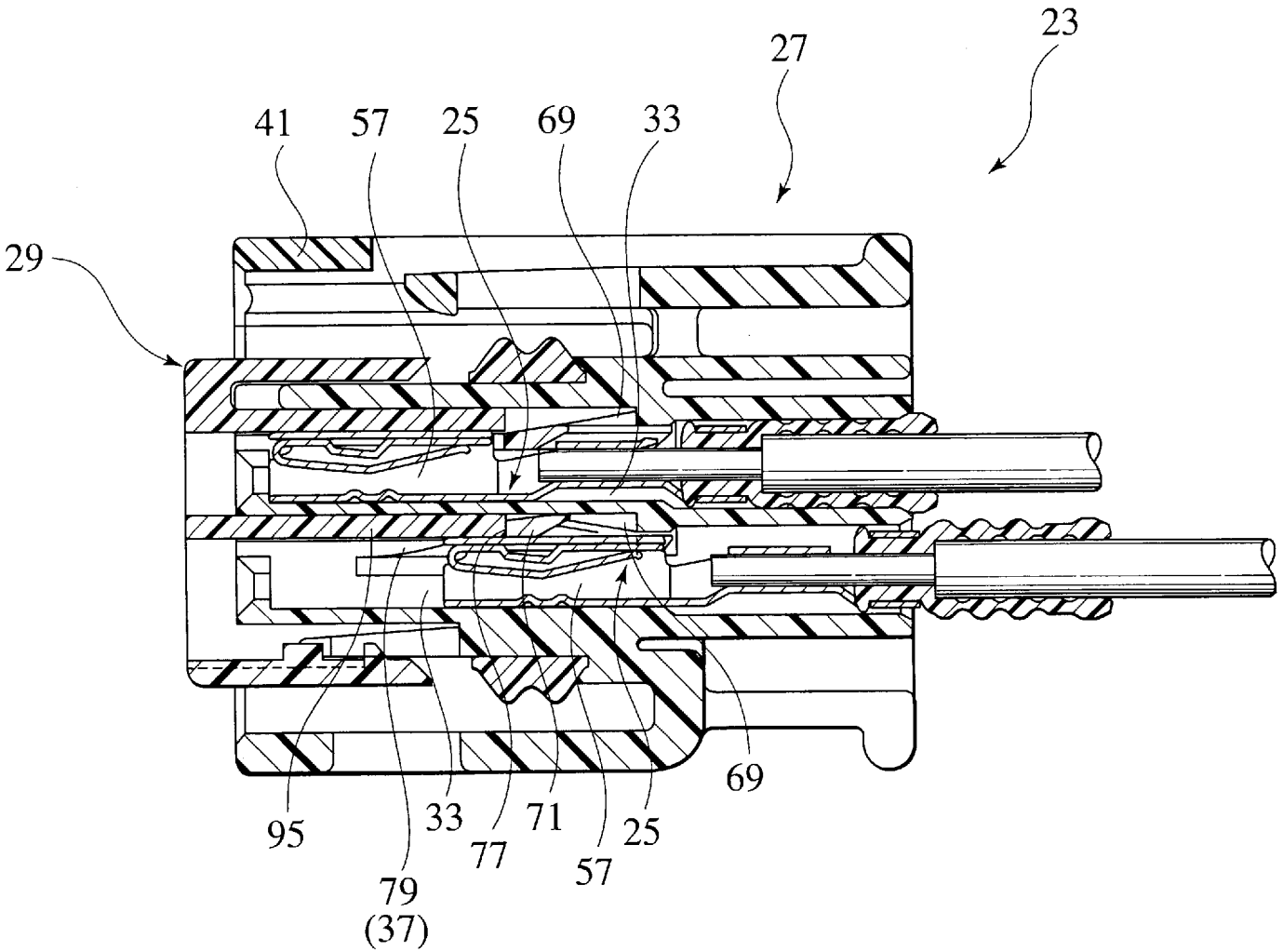
FIG. 14 is a sectional view showing a condition in which the terminal is inserted into the terminal accommodating chamber incompletely.

FIG. 14 shows a condition in which the terminal 25 is inserted into the terminal accommodating chambers 33 incompletely. At this time, the stopper protrusion 71 of the stopper portion 35 rides over the top face of the contact portion 57 of the terminal 25, so that the front end of the stopper portion 35 remains deflected upward with respect to the terminal accommodating chamber 33.

Thus, when the spacer member 29 is inserted into the fitting hood portion 41 and installed onto the housing main body 27, the front end of the contact portion 95 of the spacer member 29 avoids the bar-like bodies 79, 79 and comes into contact with the front end face 77 of the stopper protrusion 71 of the stopper portion 35 through between the bar-like bodies 79 and 79. At this time, the spacer member 29 is blocked from being installed onto the housing main body 27 by elasticity of the bar-like portions 69, 69 of the stopper portion 35. Thus, an incomplete insertion of the terminal 25 into the terminal accommodating chambers 33 can be detected.

If with the contact portion 95 of the spacer member 29 in contact with the front end face 77 of the stopper portion 35, the spacer member 29 is inserted further toward the housing main body 27 resisting elasticity of the bar-like portions 69, 69 of the stopper portion 35, the bar-like bodies 79, 79 of the deflection restricting means 37 pull the front end of the stopper portion 35 in the axial direction. Consequently, the insertion force is absorbed and thereby, restricting the front end of the stopper portion 35 from being deflected in the installation direction of the spacer member 29 onto the housing main body 27.

In the connector 23 of this embodiment, if with the insertion of the terminal 25 into the terminal accommodating chambers 33 incomplete, the spacer member 29 is inserted into the fitting hood portion 41 and installed onto the housing main body 27, the front end of the contact portion 95 of the spacer member 29 comes into contact with the front end face 77 of the stopper protrusion 71 of the stopper portion 35. Thus, the connector 23 is capable of detecting such an incomplete insertion of the terminal 25 into the terminal accommodating chambers 33.

If with the contact portion 95 of the spacer member 29 in contact with the front end face 77 of the stopper portion 35 in the connector 23, the spacer member 29 is inserted further into the housing main body 27 resisting elastic force of the bar-like portions 69, 69 of the stopper portion 35, the front end of the stopper portion 35 is pulled by the bar-like bodies 79, 79 of the deflection restricting means 37 in the axial direction so as to absorb the insertion force of the spacer member 29, thereby restricting the front end of the stopper portion 35 from being deflected in the installation direction of the spacer member 29 onto the housing main body 27. For the reason, such a damage as breaking of the stopper portion 35 with the proximal end of the bar-like portions 69, 69 as a fulcrum point can be prevented. Further, the incomplete insertion of the terminal 25 into the terminal accommodating chambers 33 can be detected securely and it is not necessary to pay special care when installing the spacer member 29 onto the housing main body 27, thereby improving installation efficiency.

In the connector 23, the bar-like bodies 79, 79 are disposed along the longitudinal direction of the terminal accommodating chambers 33 and accommodated in the stepped portion 63. Thus, the deflection restricting means 37 can be provided without enlarging the entire size of the connector.

Further, with the spacer member 29 installed onto the housing main body 27 in the connector 23, the front end of the contact portion 95 is in contact with the top face of the stopper protrusion 71, thereby preventing the front end of the stopper portion 35 from being deflected upward carelessly.

Thus, the stopper portion 35 can hold the terminal 25 in the terminal accommodating chambers 33 more securely by preventing the holding condition of the terminal 25 in the terminal accommodating chambers 33 from being released.

Although the connector 23 of this embodiment is water resistant, it is permissible that it has no water resistance.

Although the connector 23 utilizes the bar-like bodies 79, 79 as the deflection restricting means 37, for example, a stopper member may be used instead. In this case, when the stopper portion 35 is about to be deflected in the insertion direction of the spacer member 29 into the housing main body 27, the stopper member comes into contact with the stopper portion 35 so as to restrict the deflection of the spacer member 29.

Further, in the connector 23, the bar-like bodies 79, 79 may be made deflectable depending on an insertion of the terminal 25 into the terminal accommodating chambers 33 by providing an intermediate portion of each of the bar-like bodies 79, 79 with a bent portion.

Although in the connector 23, the stopper portion 35 is prevented from being deflected carelessly by the spacer member 29 installed onto the housing main body 27, it is permissible to so construct that the spacer member may not prevent the stopper portion 35 from being deflected carelessly.

Although the front end face 77 of the stopper protrusion 71 engages the upper rear end of the contact portion 57 of the terminal 25 so that the stopper portion 35 of the connector 23 holds the terminal 25 within the terminal accommodating chambers 33, the stopper protrusion 71 may engage an engaging portion or the like provided in the terminal 25.

What is claimed is:

1. A connector comprising:

a housing main body having a terminal accommodating chamber into which a terminal is to be inserted;

a stopper portion on the housing main body, the stopper portion having a flexibility configured to allow the stopper portion to be deflected outward with respect to said terminal accommodating chamber when said terminal is inserted into said terminal accommodating chamber and to be restored to an undeflected state when said terminal is inserted into said terminal accommodating chamber properly, so as to stop said terminal; and a spacer member configured to be installed in an installation direction onto said housing main body and, if insertion of said terminal into said terminal accommodating chamber is incomplete, to contact said deflected stopper portion so that the spacer member is blocked from being installed onto said housing main body, wherein said housing main body comprises deflection restricting means which, with said spacer member in contact with said stopper portion, restricts said stopper portion from being deflected in the installation direction of said spacer member onto said housing main body.

2. The connector of claim 1, wherein said deflection restricting means comprises flexible bar-like bodies linking a front end of said stopper portion with said terminal accommodating chamber along the installation direction of said spacer member and substantially preventing said spacer member from being installed onto said housing main body when insertion of said terminal into said terminal accommodating chamber is incomplete, wherein said deflection restricting means is configured to be deflected together with said stopper portion when said terminal is inserted into said terminal accommodating chamber, and wherein the deflection restricting means is configured to be in tension with the front end of said stopper portion in the axial direction when said spacer member comes into contact with said stopper portion when insertion of said terminal into said terminal accommodating chamber is incomplete.

3. The connector of claim 2, wherein said bar-like bodies are formed within the terminal accommodating chamber.

4. The connector of claim 1, wherein said spacer member is disposed outside said stopper portion when installed on said housing main body so as to restrict deflection of said stopper portion.

5. The connector of claim 2, further comprising a stopper protrusion provided between front ends of said bar-like portions while a rear end face of the stopper protrusion is inclined from a rear side to a front side, toward the terminal accommodating chamber, and wherein said stopper protrusion is configured to deflect said bar-like portions upward with respect to the terminal accommodating chamber when said terminal is inserted into the terminal accommodating chamber.

6. The connector of claim 5, wherein said spacer member contacts a top face of the stopper protrusion of said stopper portion when said spacer member is installed onto said housing main body.

* * * * *